US007812699B2

(12) United States Patent
Moia

(10) Patent No.: US 7,812,699 B2
(45) Date of Patent: Oct. 12, 2010

(54) OIL COOLING SYSTEM, PARTICULARLY FOR TRANSFORMERS FEEDING TRACTION ELECTRIC MOTORS, TRANSFORMER WITH SAID SYSTEM AND METHOD FOR DETERMINING THE COOLING FLUID FLOW IN A COOLING SYSTEM

(75) Inventor: Piero Moia, Sesto San Giovanni (IT)

(73) Assignee: Alstom Transport SA, Levallois-Perret (FR)

( * ) Notice: Subject to any disclaimer, the term of this patent is extended or adjusted under 35 U.S.C. 154(b) by 0 days.

(21) Appl. No.: 12/397,373

(22) Filed: Mar. 4, 2009

(65) Prior Publication Data

US 2009/0231075 A1 Sep. 17, 2009

(30) Foreign Application Priority Data

Mar. 12, 2008 (EP) ..... 08425152

(51) Int. Cl.
*F28D 15/00* (2006.01)
*H01F 27/10* (2006.01)

(52) U.S. Cl. ..... 336/55; 336/59; 165/104.33; 62/238.4

(58) Field of Classification Search ..... 336/55–59; 165/43, 202, 80.2, 104.33
See application file for complete search history.

(56) References Cited

U.S. PATENT DOCUMENTS 854,277 A 5/1907 Darlington
1,504,625 A 8/1924 Jones
3,942,515 A * 3/1976 Servos et al. ..... 600/555
5,243,848 A * 9/1993 Cox et al. ..... 73/19.05
5,509,274 A * 4/1996 Lackstrom ..... 62/238.4
5,669,228 A * 9/1997 Iga et al. ..... 62/238.7
6,909,349 B1 6/2005 Longardner
2004/0158428 A1 8/2004 Byrd
2006/0017537 A1 1/2006 Colmenero
2009/0318913 A1 * 12/2009 Li ..... 606/23

FOREIGN PATENT DOCUMENTS

EP 1750360 2/2007
WO 2006057516 6/2006

* cited by examiner

*Primary Examiner*—Anh T Mai
(74) *Attorney, Agent, or Firm*—Themis Law

(57) ABSTRACT

An oil cooling system, which may be employed for transformers feeding traction electric motors and for oil in a high viscosity condition, includes a first heat exchanger between a heat generating source to cooling oil that is connected by delivery and return ducts to a second heat exchanger cooling the oil by transmitting the heat absorbed at the first heat exchanger to an environment having a lower temperature than the cooling oil. The oil cooling system also includes devices flowing the cooling oil from the first to the second heat exchanger and vice versa, and devices monitoring oil flow in the circuit, for example by indicating operating conditions of the cooling system and/or by performing safety operations when the heat generating source becomes overheated.

20 Claims, 1 Drawing Sheet

OIL COOLING SYSTEM, PARTICULARLY FOR TRANSFORMERS FEEDING TRACTION ELECTRIC MOTORS, TRANSFORMER WITH SAID SYSTEM AND METHOD FOR DETERMINING THE COOLING FLUID FLOW IN A COOLING SYSTEM

FIELD OF THE INVENTION

The invention relates to an oil cooling system, for example, for transformers feeding traction electric motors. A system according to the invention includes a first heat exchanger that exchanges heat between a heat generating source and a cooling oil and that is connected by a delivery duct and a return duct to a second heat exchanger, which cools the oil by transferring heat absorbed at the first heat exchanger into an environment having a lower temperature.

In an embodiment of the invention, cooling oil flows from the first to the second heat exchanger and vice versa, and oil flow within the circuit that includes the first and the second heat exchangers and the delivery and return ducts is monitored, for example, through a control unit providing operating conditions of the cooling system and/or through a safety unit preventing an overheating of the heat generating source.

In a preferred embodiment of the invention, the heat generating source is a railway transformer, and most preferably, a transformer feeding the electric motor of a railway electric locomotive.

BACKGROUND OF THE INVENTION

Oil-based systems and methods that cool heat generating sources, such as electric transformers used in the field of railways to cool, for example, transformers feeding motors of electric locomotives, electric trains, or the like, are known in the art.

In U.S. Pat. No. 854,277, a system is disclosed for cooling an electric transformer, in particular a transformer used in the field of railways. This cooling system avoids the use of pumps, blowers and other structural parts requiring maintenance by submerging the transformer in a bath of cooling oil having a volume sufficient to absorb the heat generated by the transformer without overheating the transformer.

In U.S. Pat. No. 1,504,625, a system is disclosed for cooling an electric transformer, in particular an electric transformer used for feeding motors of electric locomotives, electric trains, or the like. This cooling system provides air as the cooling fluid, and the disclosed transformer is constructed to provide a flow of cooling air that is better distributed through the use of transformer coils, increasing cooling efficiency.

US 2006/0017537 generally discloses a cooling system of the type described hereinbefore, in which a cooling oil flows within a feeding circuit between two heat exchangers. A first exchanger absorbs the heat from the transformer and transmits it to the cooling oil, and a second exchanger absorbs the heat from the cooling oil and transmits it to the external environment, lowering the temperature of the cooling oil that is again fed to the first heat exchanger.

A drawback of oil cooling systems is that the oil flowing into the cooling circuit is monitored for safety reasons. This is accomplished by using flow meters or differential pressure sensors.

Flow meters are generally composed of a mechanical member, such as a paddle or the like whose deflection is correlated to flow velocity. When there is no flow or when the fluid flow is too slow, i.e. it is below a minimum threshold velocity, the paddle is not deflected and the flow meter is not able to detect the presence of the fluid flow.

This effect occurs when the fluid flow is too slow, but also and particularly under relatively low temperatures when the fluid and particularly the oil are subjected to an increase in viscosity.

Therefore, under such conditions conventional flow meters are not able to indicate the presence of a fluid flow or such indication is not reliable.

Differential pressure sensors are an alternative for determining the presence of a fluid flow into the circuit of a cooling system. The pressure drop occurring between the inlet and outlet of one of the heat exchangers is detected by means of such sensors. Differential pressure sensors do not have the drawbacks of flow meters when the flow is very slow or when the cooling fluid, particularly the cooling oil, has a greater viscosity.

Differential pressure sensors are not very reliable, so they must be redundant, i.e. the circuit has to be provided with more than one differential pressure sensor, particularly for guaranteeing the safety levels required in the railway field. Such unreliability leads to a more burdensome construction and, above all, higher costs of the cooling system.

In cooling systems where the cooling fluid is oil, the drawback related to viscosity increases and, accordingly, the poor reliability of the signals about cooling oil flow detected by the flow meters becomes noticeable at temperatures equal to or lower than 10° C., and becomes more and more relevant as the temperature decreases. Therefore, the poor reliability of the flow meters is not a minor drawback that occurs under extreme environmental conditions, but is a drawback having deleterious effects at the room temperatures that are normal and usual in most parts of the world.

SUMMARY OF THE INVENTION

It is an aspect of the invention to provide a system of the type hereinbefore described that overcomes the drawbacks of known systems and that is relatively economic, easy to assemble and reliable to use, providing a high level of operating safety even under very low temperatures and with very low cooling fluid flows.

A system constructed according to the principles of the invention monitors the flow of the cooling fluid flow with two or more temperature sensors provided at different locations in the cooling circuit. An electronic unit determines the temperature difference detected by the two or more sensors and compares such temperature difference with a maximum threshold value of the temperature difference that can be set in the electronic unit. The temperature difference detected by temperature sensors is compared with a threshold value to assess, and a control unit tracks the operating conditions of the cooling system and/or a safety unit performs safety operations to address an overheating of the heat source when the temperature difference is equal or larger than the threshold value.

In an embodiment of the invention, the two or more temperature sensors are provided at different locations of the cooling circuit where the temperature difference of the cooling fluid has its greatest value under conditions without cooling fluid flow or with an insufficient flow of the cooling fluid.

In particular, a first temperature sensor is provided in or at the outlet of the first heat exchanger cooling the heat generating source and a second temperature sensor is provided in or at the outlet of the second heat exchanger cooling the cooling fluid.

In construction of railway transformers where the first heat exchanger cooling the transformer includes an oil tank in thermal contact with the transformer, and a second exchanger is provided between the cooling fluid and the external environment, a first temperature sensor is provided in the tank while a second sensor is provided at the outlet of the second heat exchanger.

In one embodiment, a value from 10 to 20° C. is employed as the threshold value for the temperature difference.

In another embodiment, an oil cooling system also includes, in combination with temperature sensors, a unit directly measuring the cooling fluid flow, for example, one or more flow meters. Such unit directly measures the cooling fluid flow and acts in parallel with temperature sensors. The measurement signals produced thereby are used as measurements of the cooling fluid flow when the fluid temperature is larger than a predetermined minimum temperature.

The redundant, indirect measurement value of the fluid flow deriving from the temperature difference determined by the two or more temperature sensors may be employed for performing a diagnostic check of the operations of system devices such as temperature sensors, control electronic units and other operating units of the cooling system.

In one operating mode of an embodiment of the invention, when the oil temperature is larger than a predetermined minimum temperature, only the value provided by one or more flow meters is used as the measure of the fluid flow.

In such a case, the temperature differences detected by the temperature sensors are used for diagnosing the proper operation of the temperature sensors.

Alternatively, a differential pressure sensor may also be provided between the inlet and outlet of one of the two exchangers in combination with the two or more temperature sensors. The temperature differences measured by the two or more temperature sensors are then used as a measurement for cross-checking the proper operation of the differential pressure sensor. This embodiment is a compromise solution between the embodiment using a pair of differential pressure sensors and the first described embodiment that provides the more reliable and economic solution, because, with regard to cost, the second differential pressure sensor required for the reliability cross-check of differential pressure measurements is replaced by the two or more temperature sensors, leading to a partial reduction of the high costs when only differential pressure sensors are used as in the prior art. It is to be noted that since the differential pressure sensor is not affected by problems related to low temperatures and/or a the cooling fluid with a high viscosity, when and if required, the results provided by the system monitoring the cooling fluid flow and acting according to the temperature difference may be cross-checked.

The invention also relates to an electric transformer, in particular, an electric transformer used in the railway field especially for feeding electric motors of electric locomotives, electric trains or the like. Such transformer is provided in combination with a system cooling the transformer that uses oil as the cooling fluid.

The cooling system is constructed according to one or more combinations of the above described features.

The invention further relates to a method of monitoring the flow of cooling fluid in a cooling system that includes a cooling fluid flow circuit. In one embodiment, the method provides for an indirect measurement of the cooling flow by determining the value of the temperature difference of the cooling fluid temperatures measured in at least two different locations of a cooling fluid flow circuit, and by comparing this measured temperature difference with a predetermined maximum threshold value. When the measured difference is above the maximum threshold value, the cooling fluid flow is to be considered as insufficient or inexistent, and when it is below the fluid flow is to be considered sufficient for an effective cooling.

In combination, the method provides for directly measuring the cooling fluid flow by using a mechanical system driven directly by the cooling fluid flow. A temperature threshold value of the cooling fluid or room temperature is predefined, and when the temperature of the cooling fluid or the room temperature is below the temperature threshold value, fluid flow is determined on the basis of the temperature difference between temperature values of the cooling fluid in at least two different locations of the cooling circuit, while when the temperature is larger than the temperature threshold value the fluid flow is determined by a measurement by the mechanical system.

The redundant measurement of the fluid flow, when the oil or room temperature is larger than the threshold value, is used for diagnostic purposes of the system and devices thereof. In particular, when the temperature is larger than the temperature threshold value, measuring the fluid flow by a mechanical system provides for the measurement of the temperature sensors to be checked to determine whether it is congruent.

An alternative embodiment provides for a parallel measurement of the fluid flow in the cooling fluid flow circuit by determining the temperature difference between temperature values of the cooling fluid in at least two different locations of the cooling circuit and by determining the pressure difference between pressure values of the cooling fluid in at least two different locations of the cooling circuit, for example, the pressure difference between the inlet and outlet of a heat exchanger.

Advantages of the cooling system and of the method according to the present invention are clear from the preceding description. The differential measurement of the temperature taken in two different locations of a cooling fluid flow circuit is not affected by changes in the fluid viscosity caused by temperature changes, or by flow rate or velocity. In particular, at very low temperatures of the cooling fluid the measurement of the temperature difference between fluid temperatures in two different locations is very reliable. The threshold value of such temperature difference can be easily determined empirically, and moreover the temperature sensors have no movable portions, providing a high operating reliability and a long life. Other advantages also relate to costs, because temperature sensors are economic and devices for electrically checking the temperature sensors are simple and very reliable.

Other features of the invention are recited in the dependent claims.

BRIEF DESCRIPTION OF THE DRAWINGS

Features of the invention will become clearer from the following description of a non-limiting embodiment illustrated in the enclosed drawings, in which.

DETAILED DESCRIPTION OF EMBODIMENTS OF THE INVENTION

Figure 1:
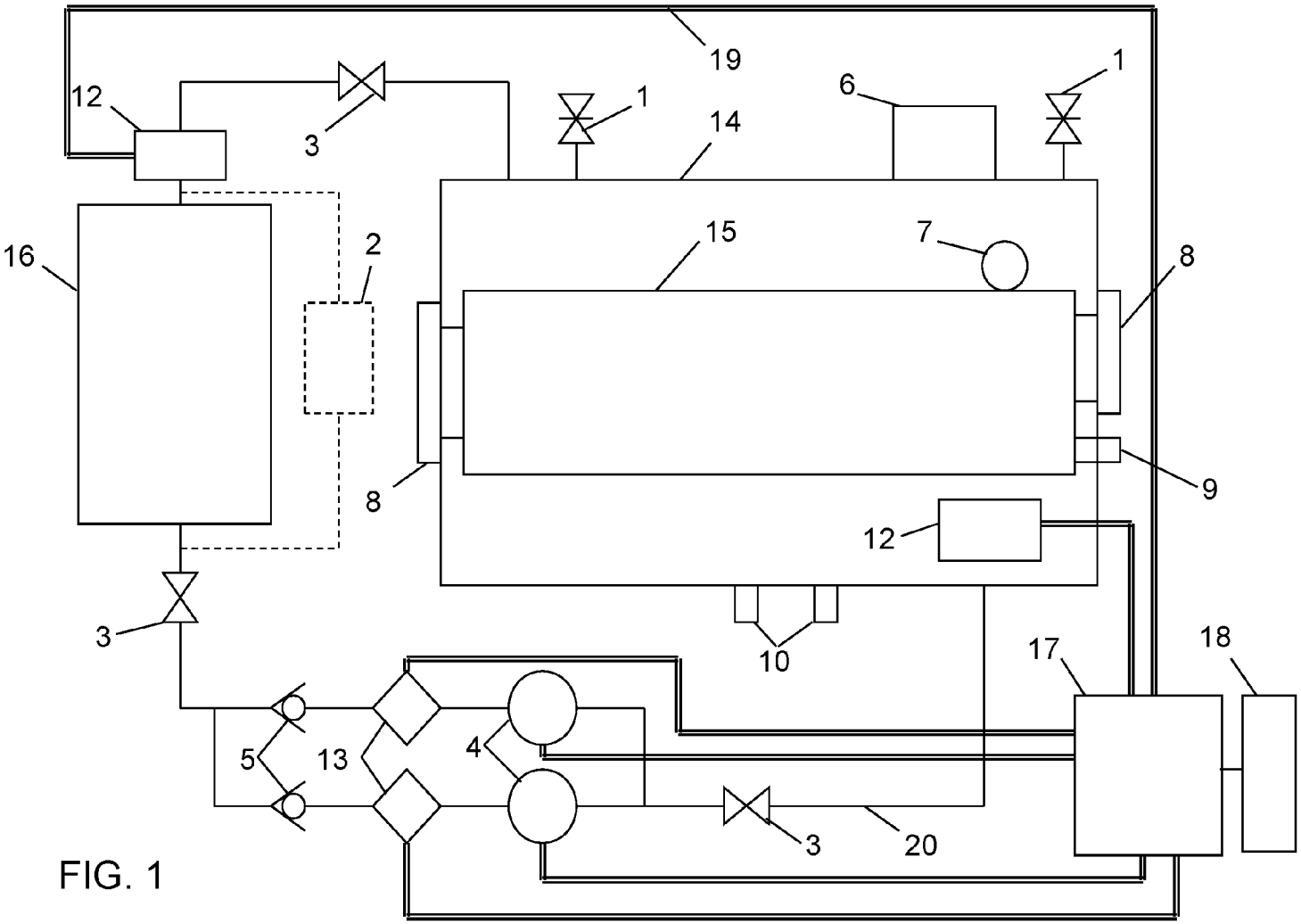
FIG. 1 depicts a block diagram of an embodiment of the invention.

Detailed descriptions of embodiments of the invention are provided herein. It should be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

With reference to FIG. 1, there is shown a schematic block diagram of an electric transformer 15 of the type used in the railway field, for example, for feeding electric motors of electric locomotives, electric trains or the like. Transformer 15 is provided in combination with a system for cooling it, for example, with a cooling fluid having a high thermal capacity such as oil or the like.

In the illustrated block diagram, transformer 15 is not shown in details, this type of construction being known to a person skilled in the art.

Transformer 15 is in thermal contact with the oil contained in tank 14, an air breather unit 7 being coupled thereto. Tank 14 acts as a first heat exchanger for transmitting heat from transformer 15, for example from windings of transformer 15 to the cooling oil. The first exchanger is operatively coupled to tank 14 and is included in a cooling circuit having a second heat exchanger 16. The cooling oil from the first heat exchanger is again cooled inside second heat exchanger 16 by dissipating the heat absorbed into the first exchanger with a thermal receptacle having a lower temperature, for example with the environment. The first exchanger with tank 14 included thereto and second exchanger 16 are connected one to the other by a delivery duct 20 and a return duct 19. In the delivery and return ducts 20 and 19, there are provided isolation valves 3, which allow pumps 4 or exchangers to be replaced.

Pumps 4 cause the cooling oil to flow between tank 14, that is, the first exchanger, and the second exchanger 16. Two pumps 4 are provided in two parallel ducts, and a non-return valve 5 is associated to each of such pumps in the corresponding duct. Tank 14 associated to the first exchanger, which is in thermal contact with transformer 15, has visual level indicators 8 and detectors 9 and 10 for the level of the cooling oil into tank 14. Moreover, tank 14 has valves 1 for draining and filtering the oil and safety relief valves 6 in the event a maximum pressure of the oil in tank 14 is exceeded.

To guarantee the proper operation of the cooling system, a temperature sensor 12 is provided at two different locations of the cooling circuit, measuring the cooling oil temperature in the respective location. Measurement signals are provided to an electronic unit determining the temperature difference detected by the two (or more) sensors 12 and comparing such temperature difference with a maximum threshold value of the temperature difference, which may be set in the electronic unit. In the embodiment of FIG. 1, the electronic unit includes an electronic processing unit 17. Therefore, electronic unit 17 determines the difference between the temperatures detected by the two sensors 12. A threshold value may be set into electronic unit 17 for that difference, and electronic unit 17 may include or operate tasks comparing the difference between the temperatures detected by sensors 12 and the threshold value set for that difference.

When the temperature difference detected by temperature sensors 12 is lower than the threshold value, the cooling oil flow is sufficient to guarantee the proper operation of the cooling system.

When the temperature difference detected by temperature sensors 12 is larger than the threshold value, the flow of cooling oil is expected not to guarantee the proper operation of the cooling system. In this case, electronic unit 17 (which may include a control unit) indicates and/or performs safety operations which are generally denoted by 18 and which may be of any type.

The two different locations in the cooling circuit where the two temperature sensors 12 are applied are such that in these locations the temperature difference of the cooling oil should theoretically have its highest value without oil flow. The best position of the two temperature sensors 12 in the circuit may also be determined empirically.

It has been found that preferred locations, i.e. locations of the cooling circuit that best meet the above criteria are the outlet of second heat exchanger 16 where the oil is expected to have its lowest temperature, and tank 14 part of the first heat exchanger where the oil is expected to have its highest temperature.

By using the differential measurement of the temperature for indirectly determining whether a sufficient fluid flow is present, the fluid flow can also be measured at very low temperatures, when oil viscosity increases and when mechanical systems such as flow meters cannot operate properly.

With oils that are usually used as cooling fluids, oil flow by the above described differential temperature measurement is determined when oil temperature is below 10° C.

Cooling oil flows may be reliably detected at very low temperatures, down to about −40°, by indirectly measuring the difference in oil temperature at different locations of the cooling circuit.

The above arrangement of temperature sensors 12 is not to be considered as a limiting, but as one of the preferred arrangements.

Alternative preferred arrangements of temperature sensors 12 may be directly at the outlets of the two heat exchangers, i.e. second heat exchanger 16 cooling the oil and the first heat exchanger cooling transformer 15 or inside said exchangers.

As shown in FIG. 1, in parallel to temperature sensors 12 for determining the oil temperature difference at two different locations of the circuit, there is provided at least one flow meter 13 within the circuit. In particular, a flow meter 13 is provided for each delivery duct where one of the two pumps 4 is provided that is operated in parallel.

Flow meter or flow meters 13 are of a type known to a person skilled in the art and include a paddle or a similar device whose deflection is correlated to flow velocity. Flow is measured on the basis of a larger or smaller deflection of the paddle.

In one embodiment of the invention, signals deriving from flow meters 13 are employed for determining the flow of the cooling oil in alternative to signals deriving from the measurement of the difference in oil temperature provided by the two temperature sensors when the reference temperature exceeds 10° C. Therefore, such temperature value is a threshold value of the oil or room temperature, by means of which information about the flow of cooling oil is detected by the one or more flow meters or is indirectly determined by measuring the difference in oil temperature at two different locations of the cooling circuit.

When oil temperature exceeds 10° C., and so the threshold value of the oil or room temperature, then the measurement of the flow of cooling oil obtained indirectly by the difference in oil temperature at different locations of the cooling circuit may be used for diagnostic purposes. In particular, this measurement is used for checking the proper operation of temperature sensors 12.

A differential pressure sensor 2 is shown in FIG. 1 in broken lines. Differential pressure sensor 2 is a sensor known in the art determining the pressure difference between two different locations of a circuit. The differential pressure measurement can be used as an indirect measurement of the flow of the fluid, particularly when the two different measurement locations are separated by a circuit section having a high resistance to flow. In such case, the differential sensor may measure the pressure difference between the inlet and outlet of second heat exchanger 16 cooling the oil. In this embodiment differential pressure sensor 2 is provided instead of flow meter or flow meters 13. Like temperature sensors 12, differential pressure sensor 2 is not affected or is affected to a lower extent by increases in the viscosity of the cooling oil at low temperatures.

In the embodiment illustrated in FIG. 1, differential pressure sensor 2 is used for determining fluid flow on the basis of the difference in pressure detected at two different locations of the circuit and of the comparison between such pressure difference value and a predetermined threshold value. Measurements of fluid flow values obtained by the double system composed of temperature sensors 12, which determine the difference in temperature of the cooling oil at two different locations of the circuit, and of differential pressure sensor or sensors 2 are used in this embodiment as a parallel device for checking the proper operation of differential pressure sensor (s) 2 and/or temperature sensors 12. An opposite construction may also be provided, that is, the main measurement of the flow of fluid may be detected by temperature sensors 12 while differential pressure values may be used for checking the proper operation of temperature sensors 12 and of evaluation electronic unit 17.

It is to be noted that the teachings disclosed herein are applicable to any kind of arrangement of a cooling system for transformers, and that a person skilled in the art may change existing cooling systems to allow for the application of the present invention.

While the invention has been described in connection with a number of embodiments, it is not intended to limit the scope of the invention to the particular forms set forth, but on the contrary, it is intended to cover such alternatives, modifications, and equivalents as may be included within the scope of the invention.

What is claimed is:

1. A cooling system comprising:

a first heat exchanger exchanging heat between a heat generating source and a cooling fluid;

a second heat exchanger cooling the cooling fluid by transmitting the heat absorbed by the cooling fluid at the first heat exchanger to an environment having a temperature lower than the cooling fluid;

a delivery duct;

a return duct, the delivery and the return ducts fluidly connecting the first heat exchanger to the second heat exchanger to form a circuit;

a unit causing the cooling fluid to flow from the first to the second heat exchanger;

a unit monitoring flow of the cooling fluid in the circuit, the unit monitoring flow comprising a plurality of temperature sensors provided at different locations of the cooling circuit; and an electronic unit measuring a temperature difference between temperatures detected by the plurality of temperature sensors and comparing the temperature difference with a maximum threshold value set in the electronic unit, the electronic unit further determining whether the temperature difference is larger or smaller than the maximum threshold value, wherein the unit monitoring flow indicates operating conditions of the fluid cooling system and/or performs safety operations preventing the heat generating source from becoming overheated when the temperature difference exceeds the threshold value.

2. The system of claim 1, wherein the plurality of temperature sensors are provided at the different locations of the circuit where the temperature difference of the cooling fluid has a greatest value without a flow or with an insufficient flow of the cooling fluid.

3. The system of claim 1, wherein a first of the plurality of temperature sensor is provided at an outlet of the first heat exchanger and a second of the plurality of temperature sensor is provided at an outlet of the second heat exchanger.

4. The system of claim 1, wherein the heat generating source is a railway transformer, wherein the cooling fluid is oil, wherein the first heat exchanger cooling the transformer comprises an oil tank in thermal contact with the transformer, wherein a first temperature sensor is provided in the tank, and wherein a second temperature sensor is provided at an outlet of the second heat exchanger.

5. The system of claim 1, further comprising means for directly measuring the flow of the cooling fluid, the means for directly measuring the flow of the cooling fluid being arranged to act in parallel with the temperature sensors and to provide measurement signals of the flow of the cooling fluid when fluid temperature exceeds a predetermined minimum temperature.

6. The system of claim 5, wherein the means for directly measuring the flow of the cooling fluid comprise one or more flow meters.

7. The system of claim 5, wherein the predetermined minimum temperature is 10° C.

8. The system of claim 5, wherein the electronic unit is configured to diagnostically check proper operation of devices within the cooling system based on the temperature difference detected by the plurality of temperature sensors.

9. The system of claim 1, further comprising a differential pressure sensor measuring a pressure difference between an inlet and an outlet of one of the first or the second heat exchangers, the electronic unit being configured to check proper operation of the differential pressure sensor and/or other devices within the cooling system based on the temperature difference.

10. The system of claim 9, wherein the differential pressure sensor is arranged to act in parallel with the plurality of temperature sensors and provides measurement signals of the flow of the cooling fluid when the fluid temperature exceeds a predetermined minimum temperature.

11. The system of claim 10, wherein the predetermined minimum temperature is 10° C.

12. The system of claim 1, wherein the threshold value is between 10 and 20° C.

13. An electric transformer system comprising:

an electric transformer;

a cooling system operably coupled to the electric transformer, the cooling system comprising:

a cooling circuit comprising, a first heat exchanger exchanging heat between the electric transformer and a cooling fluid;

a second heat exchanger cooling the cooling fluid by transmitting the heat absorbed by the cooling fluid at the first heat exchanger to an environment having a temperature lower than the cooling fluid;

a delivery duct;

a return duct, the delivery and the return ducts fluidly connecting the first heat exchanger to the second heat exchanger;

a unit causing the cooling fluid to flow from the first to the second heat exchanger;

a unit monitoring flow of the cooling fluid in the circuit, the unit monitoring flow comprising a plurality of temperature sensors provided at different locations of the cooling circuit; and an electronic unit measuring a temperature difference between temperatures detected by the plurality of temperature sensors and comparing the temperature difference with a maximum threshold value set in the electronic unit, the electronic unit further determining whether the temperature difference is larger or smaller than the maximum threshold value, wherein the unit monitoring flow indicates operating conditions of the fluid cooling system and/or performs safety operations preventing the heat generating source from becoming overheated when the temperature difference exceeds the threshold value.

14. A method of monitoring flow of a cooling fluid in a cooling system, the cooling system comprising a cooling fluid circuit, the method comprising:

measuring the flow by determining a value of a temperature difference of the cooling fluid between cooling fluid temperatures measured at a plurality of different locations of the cooling fluid circuit; and comparing the temperature difference with a predetermined maximum threshold value, wherein the flow is determined to be insufficient or inexistent when the temperature difference is larger than the maximum threshold value and is determined to be sufficient when the temperature difference is smaller than the maximum threshold value.

15. The method of claim 14, further comprising the step of:

defining a temperature threshold value of the temperature of the cooling fluid or of a room temperature; and measuring the flow by mechanical means driven directly by the flow, wherein when the temperature of the cooling fluid or the room temperature is below the temperature threshold value, the flow is determined on the basis of the temperature difference, and wherein when the temperature of the cooling fluid or the room temperature is higher than the temperature threshold value, the flow is measured with the mechanical means.

16. The method of claim 15, wherein measuring the flow by determining a value of a temperature difference comprises providing a flow value for diagnostically checking system devices when the temperature of the cooling fluid or the room temperature is higher than the temperature threshold value and the flow is measured with the mechanical means.

17. The method of claim 14, wherein measuring the flow further comprises parallely measuring the flow of the cooling fluid circuit by determining the temperature difference and by determining a pressure difference between pressure values of the cooling fluid at a plurality of different locations of the cooling circuit.

18. The method of claim 17, wherein the plurality of different locations of the cooling circuit comprises an inlet and an outlet of one of the first or the second heat exchangers.

19. The method of claim 17, further comprising the step of diagnostic checking system devices on the basis of fluid flow values determined by measuring the temperature difference and/or by measuring the pressure difference.

20. The method of claim 19, wherein the system devices comprise one or more of temperature sensors and of a differential pressure sensor.

* * * * *